United States Patent [19]

Sparks et al.

[11] Patent Number: 4,719,008

[45] Date of Patent: Jan. 12, 1988

[54] SOLVENT EXTRACTION SPHERICAL AGGLOMERATION OF OIL SANDS

[75] Inventors: Bryan D. Sparks; F. Weldon Meadus, both of Ottawa; Enrique O. Hoefele, Calgary, all of Canada

[73] Assignee: Canadian Patents and Development Ltd., Ottawa, Canada

[21] Appl. No.: 870,422

[22] Filed: Jun. 4, 1986

[30] Foreign Application Priority Data

Jun. 28, 1985 [CA] Canada ..... 486032

[51] Int. Cl.[4] ..... C10G 1/04

[52] U.S. Cl. ..... 208/390; 208/391

[58] Field of Search ..... 208/390, 391

[56] References Cited

U.S. PATENT DOCUMENTS

| | | | |
|---|---|---|---|
| 2,903,407 | 9/1959 | Fischer et al. | 208/390 |
| 3,556,982 | 1/1971 | Kaminsky et al. | 208/390 |
| 4,120,777 | 10/1978 | Globus | 208/391 |
| 4,131,535 | 12/1978 | Parteons | 208/391 |
| 4,160,718 | 7/1979 | Rendall | 208/390 |
| 4,274,948 | 6/1981 | Robinson | 208/390 |
| 4,282,103 | 8/1981 | Fuhr et al. | 208/391 |
| 4,459,200 | 7/1984 | Dente et al. | 208/390 |
| 4,491,512 | 1/1985 | Euker, Jr. | 208/390 |

FOREIGN PATENT DOCUMENTS

| | | | |
|---|---|---|---|
| 675524 | 12/1963 | Canada | 208/390 |
| 687554 | 5/1964 | Canada | 208/390 |
| 873852 | 6/1971 | Canada | 208/390 |
| 1031712 | 5/1978 | Canada | 208/390 |
| 1169002 | 6/1984 | Canada | 208/390 |

OTHER PUBLICATIONS

Sanford, Canadian J. Chem. Eng., 61, (1983) pp. 554–567.

*Primary Examiner*—Asok Pal

*Attorney, Agent, or Firm*—Alan A. Thomson

[57] ABSTRACT

Oil sands and similar hydrocarbon-solids mixtures are separated into their components by steps comprising: mixing with a solvent for the hydrocarbon in an extraction-contacting stage including a controlled light milling action, in the presence of hydrophilic bridging liquid, under selected conditions favoring the formation of large agglomerates of substantially all hydrophilic solids; controlling the milling action to break down continuously the agglomerates so that at equilibrium the agglomerate size is much smaller than expected; separating the agglomerates from the concentrated hydrocarbon solution and stripping solvent from this solution to leave hydrocarbon product; washing the agglomerates with solvent and recycling this dilute wash solution preferably to the extraction-contacting; desolventizing the agglomerates and recycling solvent preferably to the wash stage. The agglomerates have fast settling and draining properties and a low hydrocarbon content while the hydrocarbon product has a low solids content. An apparatus for carrying out this process is described.

24 Claims, 7 Drawing Figures

FIG. 1 GENERALIZED SOLVENT EXTRACTION (PRIOR ART)

DISTRIBUTION OF WASHING RATES

WT. % NAPHTHA VS. WT. % WATER IN EXTRACTED SAND

SOLVENT EXTRACTION SPHERICAL AGGLOMERATION OF OIL SANDS

The present invention provides an improved and more efficient method and apparatus for the solvent extraction of viscous oil or hydrocarbons from solids, e.g., from oil-impregnated particulate solids, particularly bitumen from oil sands.

BACKGROUND AND PRIOR ART

Oil sands are sand deposits impregnated with a viscous hydrocarbon, bitumen, which occur in various locations throughout the world. One of the largest deposits, and currently the only one being commercially exploited on a large scale, is located in the Athabasca region of the Province of Alberta, Canada. Athabasca oil sands consist of a three component mixture of mineral matter, bitumen and water. The valuable component, bitumen, can range from nearly 0 up to 20 wt% with an average value being about 10 wt%. Connate water typically runs between 3 wt% and 6 wt%. The mineral matter is composed of sands, silts and clays and usually ranges between about 80 wt% and 90 wt% of the deposit. The fines are those mineral materials containing the clays, silts and fine sands which pass through a 325 mesh screen (<44 micron) and are responsible for a great many processing problems. Generally the clay content increases as the oil content or ore grade decreases. For a more complete fines description see R. N. Yong and A. J. Sethi, Mineral Particle Interaction Control of Tar Sand Sludge Stability, The Journal of Canadian Petroleum Technology, Volume 17, Number 4 (October-December 1978).

Currently only the Hot Water process is being used commercially to exploit this resource. This process is well described in the patent and technical literature. In the two commercially operating hot water plants, Syncrude and Suncor, it is the fine mineral matter that is largely responsible for sludge accumulation and tailings disposal problems.

Several solvent extraction processes for the recovery of bitumen from oil sands have been proposed, with the object of overcoming the problems inherent to the hot water process, but to this data no commercially acceptable process has reached fruition. The propensity for fines and other small particles to impede separation of the solids and bitumen solution has been a perennial problem and many techniques to overcome this difficulty have been devised. One technique is to slurry the oil sand in an appropriate solvent after which the mineral matter is classified into a coarse fraction and a fines fraction. By so doing, the fines are removed and treated separately. This is done in order to avoid the problems of blockage in subsequent processing when the coarse mineral matter is washed and the solvent recovered. A typical example of this approach may be found in Canadian Pat. No. 1,169,002 June 12/84 G. B. Karnofsky in which the mineral matter is classified into a major coarse fraction and a minor fines fraction. Solvent is then percolated through beds of the coarse sands to extract bitumen and to wash the sands, while an elaborate series of thickeners, clarifiers and filters are used to treat separately the fines fraction.

Another technique is to add small amounts of water to encapsulate and agglomerate the small particles so that they behave like larger particles which will not migrate through the bed. Thus the addition of a minimal amount of water can improve filtration rates and greatly reduce bed plugging. This method should be effective for Oil Sands containing low and medium amounts of fine mineral matter. An example of this technique, using a high grade (low fines) feed containing more than 10% bitumen, may be found in Canadian Pat. No. 873,852 June 22/71 A. M. Benson in which the filtration rates of the sand solvent mixtures are improved by the addition of water. Up to a total of only 7% water was used to form a "grainy slurry", resulting in an increased filtration rate and elimination of the clay layer usually formed on top of the filter bed.

A method in which fines and sands are separated from the extraction solvent by a spherical agglomeration technique is disclosed in Canadian Pat. No. 1,031,712, May 23, 1978, F. W. Meadus et al. In this process the fines, in conjunction with an aqueous bridging liquid, are utilised to promote binding of the coarse particles into large, dense, compact agglomerates which can be easily separated from the extractant by simple screening. By this means, feed containing high fines are easily handled but a major problem is that feeds with a fines content of less than about 15 wt% are not amenable to this approach due to poor agglomerate strength and must therefore be processed in other ways.

Figure 1:
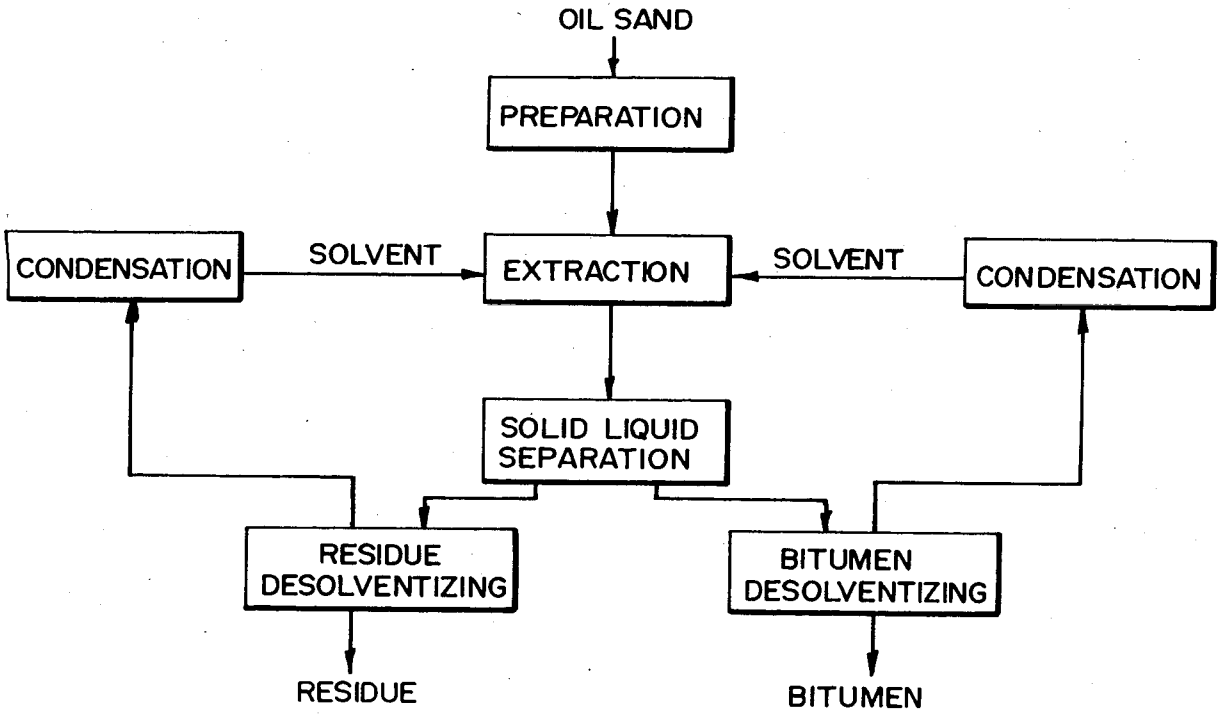
FIG. 1 is a generalized flowsheet of prior art solvent extraction processes with solid-liquid separation and solvent recycle.

In the prior art solvent extraction of oil sand, the main steps can be depicted by the flow diagram of FIG. 1. The crude oil sands are prepared for extraction by breaking down lumps and removal of gross impurities, and then subjected to solvent extraction in a solid-liquid contacting apparatus. The resulting mixture is separated into bitumen solution and solid residue. Solvent is stripped from both solution and residue and recycled to the extraction. The main problem with this process is in the solid-liquid separation step: the separation is either too slow to be practical or is incomplete, allowing too much fine solids into the bitumen and/or too much solvent/bitumen into the residue. The bitumen loss to the residue tends to render the process uneconomic, while fine solids in the bitumen can render it unacceptable for further processing (refining). It is desirable to develop a process which overcomes or avoids these problems.

SUMMARY OF THE INVENTION

The invention includes a process for continuous extraction/agglomeration of oil sands or of like particulate solids with associated hydrocarbon, using an organic solvent and a substantially immiscible bridging liquid for the solids, whereby bitumen or other hydrocarbon is extracted and solids agglomerated, the agglomerated solids being quickly separable from the solution, comprising:

(a) mixing oil sands or the like in an extraction-contacting stage with a solvent for the hydrocarbon and with a hydrophilic bridging liquid under selected conditions which favor the formation of large agglomerates of the solids, continuously breaking down the agglomerates by a controlled light milling action until small solid agglomerates of rapid draining character and substantially free of occluded hydrocarbon and solvent, are formed in the mixture;

(b) discharging the agglomerated mixture to a solid/-liquid separating stage, and separating the agglomerates from the hydrocarbon solution;

(c) washing the separated solid agglomerates using a solvent for the hydrocarbon and separating wash solvent from said agglomerates;

(d) recycling at least part of the wash solvent recovered from the washing step (c) to the extraction step (a);

(e) stripping solvent from the solution of hydrocarbon from step (b) and separately recovering solvent and bitumen or other hydrocarbon product;

(f) desolventizing the washed agglomerates to recover residual solvent;

(g) recycling recovered solvent from (e) and (f) to the washing step (c); and (h) disposing of the waste solids from the desolventized agglomerates as either a dry solid, or heavy slurry in water.

Preferably the primary extraction-contacting stage is carried out in a slowly rotating vessel in which the milling action is provided by gently tumbling mixing media and where the weight of each element of the mixing media is large enough to overcome the cohesive forces binding the hydrophilic particles together and to the media elements and where the impact forces involved are insufficient to comminute the solids significantly; thereby preventing formation of large agglomerates while allowing the bridging liquid to displace internally trapped solvent and form small agglomerates of reduced solvent content. Preferably the bridging liquid is aqueous and the desired water to solid wt. ratio is selected within the range of 0.08 to 0.5 depending on the nature and type of material being processed, with higher water content required for higher porosity and/or finer solid materials being agglomerated.

It has been found desirable that the extraction-contacting (a) be controlled to produce agglomerates of the size from about 0.1 mm to about 2 mm diameter containing minimal levels of solvent and hydrocarbon; and also so that the solution separated in (b) contains less than about 2% average, based on hydrocarbon in solution, of fine solids.

The invention further includes an apparatus for continuous solvent extraction/agglomeration of oil sands or of like particulate solids with associated hydrocarbon, using an organic solvent and a substantially immiscible bridging liquid for the solids whereby bitumen or other hydrocarbon is extracted and solids agglomerated, and for separating the agglomerated solids from the extract solution, comprising:

(a) an enclosed contacting-agglomeration vessel in which hydrocarbon is extracted and solids caused to form into agglomerates;

(b) means of metering a solid feed material into said enclosed contacting-extraction-agglomeration vessel;

(c) means of metering solvent and water into said enclosed contacting-extraction-agglomeration vessel;

(d) means to cause rotation of the contents of said vessel;

(e) means for removing the agglomerated solids and the hydrocarbon solution co-currently or countercurrently from said contacting-extraction-agglomeration vessel;

(f) means for separating the agglomerated solids from the oil or hydrocarbon solution;

(g) means for washing and draining agglomerated solids including means to discharge and recycle washing liquid to the contacting-extraction vessel;

(h) means for separating said hydrocarbon solution into solvent and hydrocarbon, including means to recover said solvent and hydrocarbon product;

(i) a desolventizing unit for removing residual solvent from said washed agglomerates; and (j) means to recycle recovered solvent to the washing unit (g).

Preferably the vessel (a) is lined with a solvent-resistant hydrophobic polymeric material and contains mixing media of the class including steel rods, balls and heavy autogenous objects from oil sands.

DETAILED DESCRIPTION

The hydrocarbon-solids mixtures to be separated may be oil sands or bituminous tar sands, oil-bearing diatomites, oil shales, tar-saturated sandstones and the like. Some oily sludge wastes also could be treated in this manner.

The starting material should be free of gross impurities (e.g. large lumps, rocks etc.) and, if necessary, comminuted to an appropriate particle size where internal hydrocarbon is released. Usually the ultimate particle size will be below about 0.3 mm diameter (or—50 mesh screen, US Sieve Series). Typical low and medium grade oil sands as mined contain clay, silt and fine sands, which pass a 325 mesh screen, in amounts up to about 50%.

The solvent is selected from organic solvents which will dissolve the oil or hydrocarbon. Suitable solvents include naphtha, particularly naphtha fractions from bitumen upgrading and such fractions partially loaded with bitumen (when bitumen-containing oil sands are to be processed); aromatic solvents of the class including benzene, toluene and xylene; halogenated solvents of the class including methylene chloride, carbon tetrachloride, trichlorotrifluoroethane and trichloroethylene; and cyclic aliphatic compounds of the class including cyclohexane; and mixtures thereof. The same solvents may be used for the washing stages as for the initial extraction preferably with the loaded wash solvent being recycled to the extraction-contacting stage.

The amount of solvent used is sufficient to provide a fluid mixture preferably with a pulp density or solids content in the range of about 40 to 60% wt. solids. Normally the solvent to oil or hydrocarbon ratio in extraction step (a) is selected to give a product solution in step (b) containing from about 10% to 70% wt. oil, bitumen or hydrocarbon.

The bridging liquid will necessarily be substantially immiscible with the solvent, and also hydrophilic assuming the oil or hydrocarbon is hydrophobic and the solids are basically hydrophilic. Water and aqueous solutions are usually found most suitable. Aqueous bridging liquids may contain additives selected to promote wettability of the particulate solids in order to improve solid-liquid separation efficiency. Such additives include alkali metal pyrophosphates, orthophosphates and oxalates, alkali metal hydroxides, alkali metal silicates and surfactants particularly petroleum sulphonate. It has been found that a desirable pH range is within about 8–10.

The amount of bridging liquid preferably is selected within the range of wt. ratios (of bridging liquid to solids to be agglomerated) of 0.08 to 0.5, most preferably within 0.08 to about 0.15 for low grade oil sands. The amount selected depends on the nature or condition and type of material being processed e.g. it has been found that higher amounts of bridging liquid are required for higher porosity and/or finer solids being agglomerated.

The feed rates of the oil sands or the like, solvent and bridging liquid preferably will be chosen to give sufficient retention time in stage (a) for efficient extraction and agglomeration, normally not to exceed about 20 min. Either lower temperatures or feeds with high fines contents require longer retention times.

During this extraction-contacting stage (a) it has been found important to incorporate a controlled light milling action to promote the transformation of the agglomerates from soft masses, which occlude considerable solvent and bitumen or hydrocarbon, into small solid agglomerates of rapid draining character which are as free as possible of occluded solvent and hydrophobic materials. The light milling action should be controlled to be severe enough to continuously break down the soft agglomerates, without significant comminution of the solids therein, until small solid agglomerates are formed which resist and survive the milling action. These later agglomerates separate readily from the mixture and allow rapid draining of solvent through a mass thereof.

We have found that one preferred way of providing such a light milling action is to incorporate mixing media into the charge during the extraction-contacting stage. Suitable mixing media include steel rods, balls and heavy autogenous objects from oil sands. It has been found preferable for best results that the volume occupied by the mixing media be selected within the range of about 5 to about 20% of the vessel volume, while the charge occupies between about 10 and about 60% of the vessel volume. For best results, the vessel containing the charge and mixing media should be rotated slowly, the speed being selected within the range of about 10% to about 40% of the critical speed. The critical speed is that speed at which the charge ceases to tumble down the side of the rotating vessel and adheres to or follows the side of the vessel substantially through 360°. The weight of the mixing media employed most suitably is sufficient that cohesive forces holding particles together can be broken by the media but insufficient to comminute individual particles to any noticeable extent. In small pilot scale tests in vessels of from 12 to 15 inch diameter, from 8 to 15 one-inch diameter steel rods were found to be suitable mixing media the rods being the length of the extraction-contacting zone.

Figure 3:
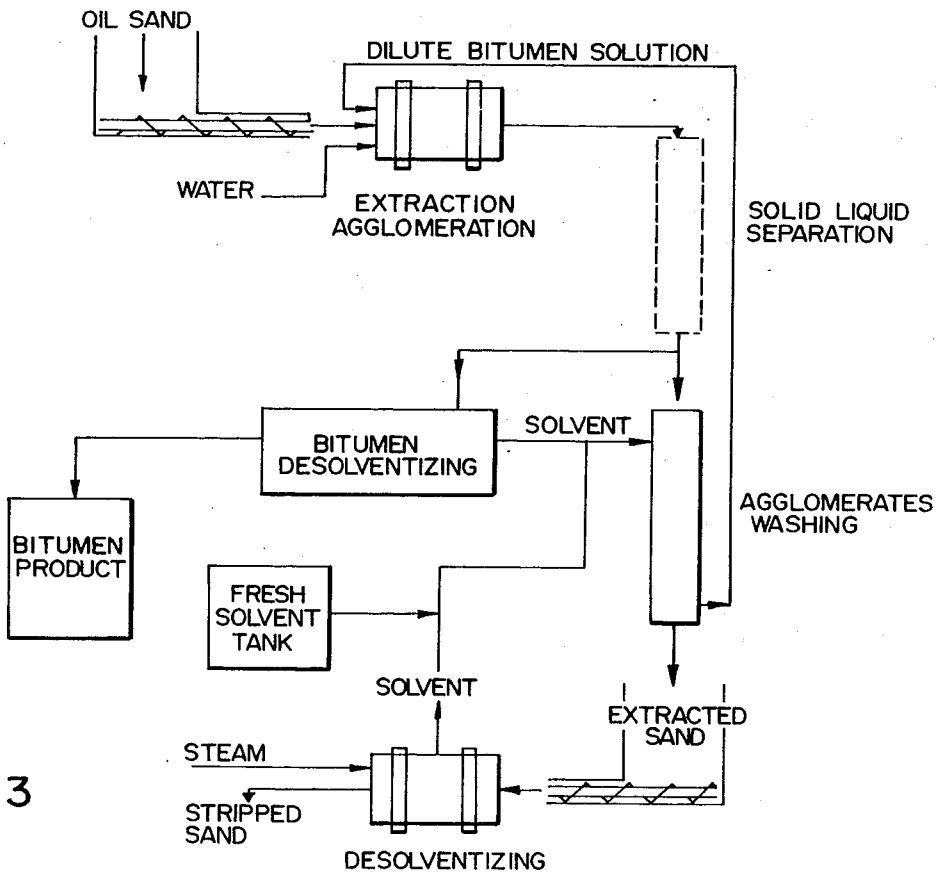
FIG. 3 is a flowsheet of one version of the extraction-/agglomeration process according to the present invention.
Figure 4:
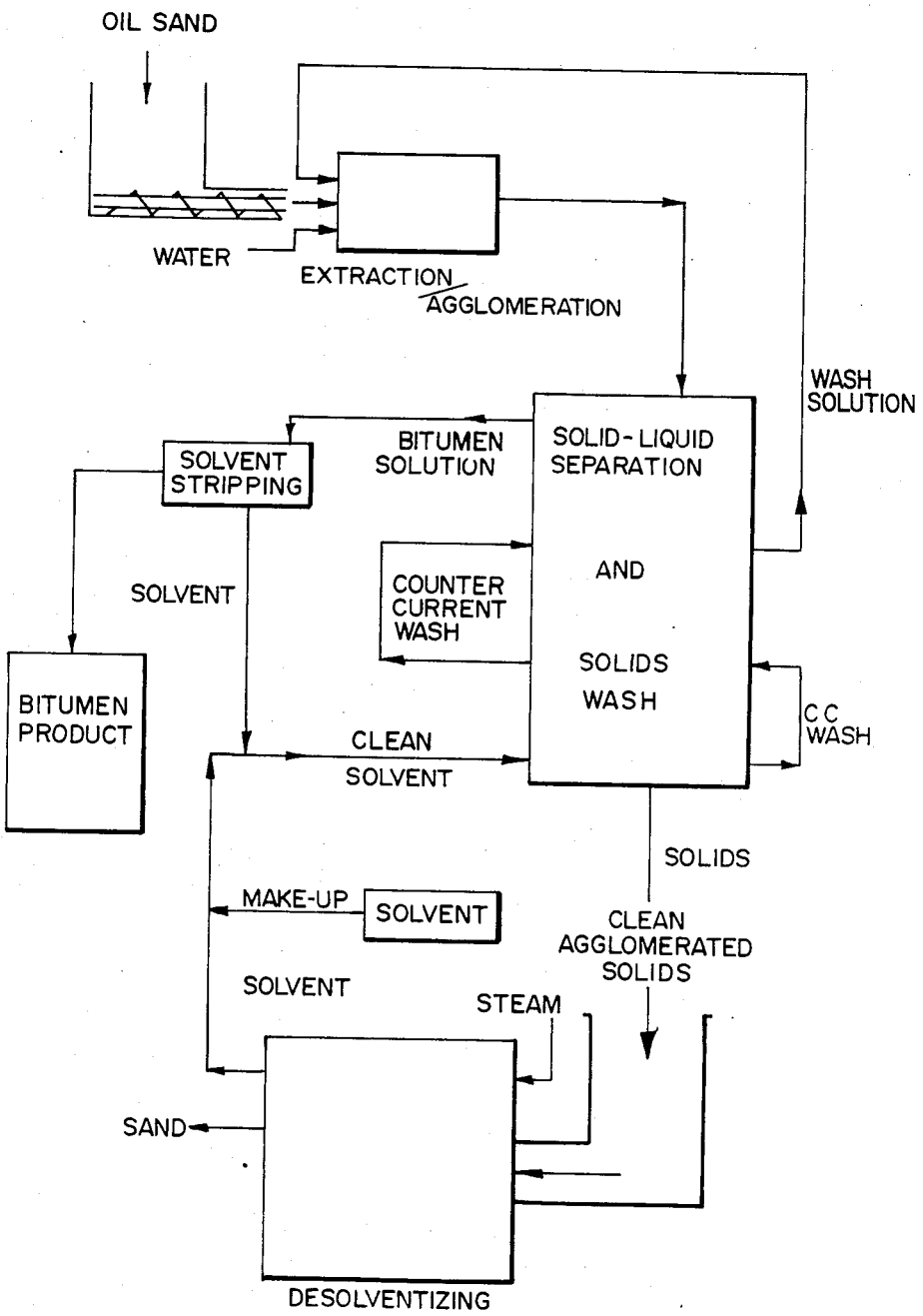
FIG. 4 is a flowsheet of another version of the extraction/agglomeration process of the present invention.

In the latter stages of the extraction-contacting it appears that substantially all of the hydrophilic particles have become surrounded by a layer of the aqueous bridging liquid, and the bridging liquid is able to cohere these particles into solid agglomerates in spite of the contrary milling action. Eventually an equilibrium between cohesive and destructive forces is reached and agglomerates below about 2 mm diameter are formed which survive the milling action. These agglomerates are separated from the mixing media and then from the solution of bitumen or hydrocarbon. Compared to unagglomerated material, these agglomerated solids have been found to be remarkably low in organic content (occluded solvent and bitumen/hydrocarbon). From FIG. 6 it is evident that from about 5–8% solvent remains in the agglomerates, which can be removed by desolventizing as shown in FIGS. 3 and 4. Still lower solvent levels are possible.

It has been found preferable to have a discharge zone. Various forms of screens to retain the mixing media coupled with transport of agglomerated slurry to discharge chutes, would serve this purpose (to allow separation of the agglomerate slurry from the mixing media).

Figure 2:
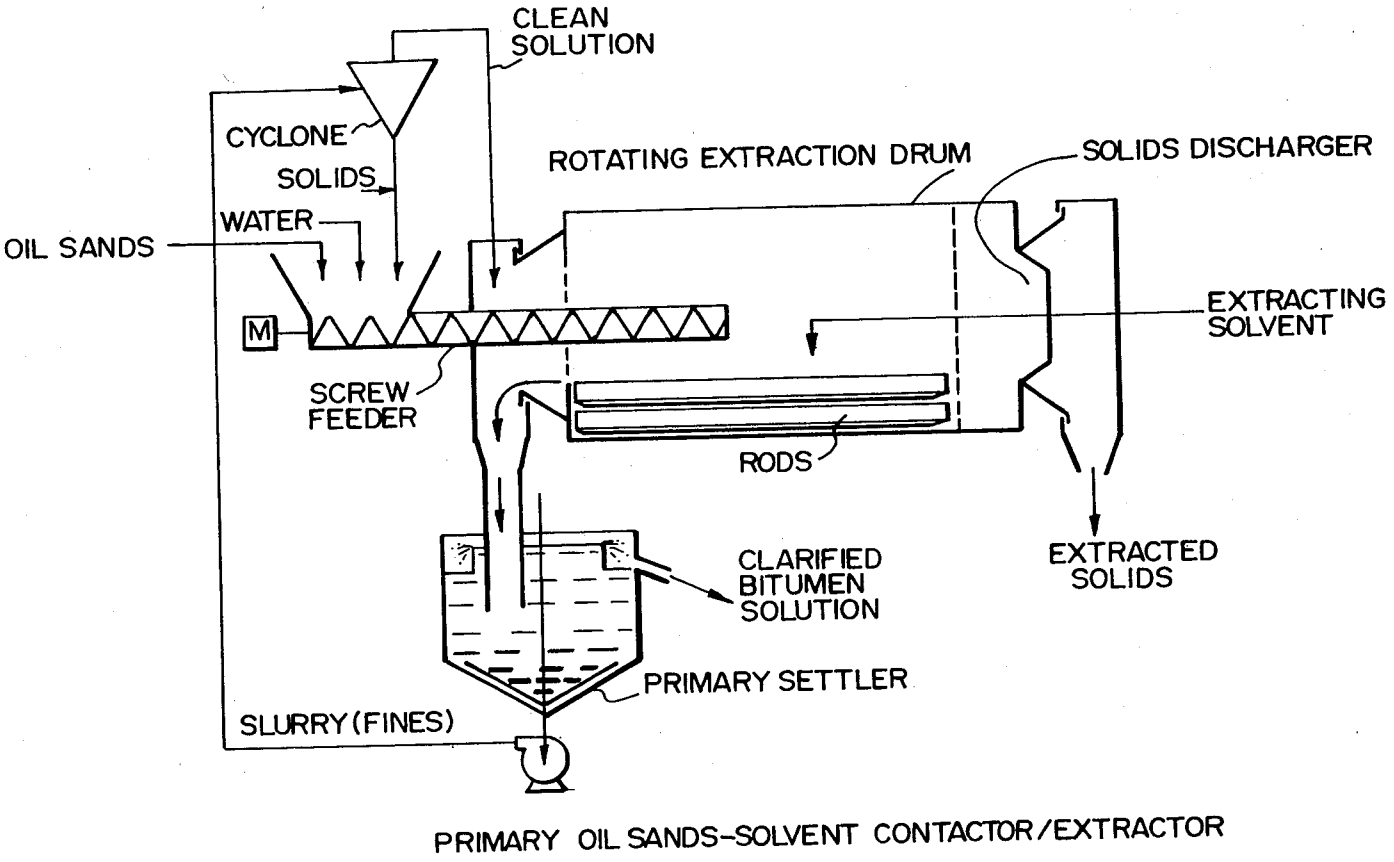
FIG. 2 is a schematic diagram of one extraction-contacting apparatus for carrying out the process of the present invention.

It is possible to arrange for countercurrent flow of solids and liquids during the extraction-contacting as shown in FIG. 2. By arranging the extracting solvent input in a central location and the extraction solution exit remote from the agglomerate discharge, continuous countercurent flow can be established.

The bitumen/hydrocarbon solution after separation from the agglomerates, is stripped of the solvent (by evaporation or distillation and condensation) as indicated in FIGS. 3 and 4. The bitumen or hydrocarbon product is recovered for further processing, while the solvent is recycled. The bitumen product from oil sands has been found to have a low solids content when the solvent content in the agglomerates is also low. The process can be controlled so that the solution separated from the agglomerates contains an average of less than about 2% wt., based on bitumen or hydrocarbon content in solution, of fine solids. The agglomerates, after separation from the charge mixture and from the extract solution, are washed to remove bitumen or hydrocarbon on or accessible from the agglomerate surface. Clean (including recycled) solvent preferably is used for this purpose with the resulting wash solution being a preferred extraction solvent for the extraction-contacting (a). Preferably the solvent and agglomerates during the washing move countercurrently as indicated in FIG. 4.

Optionally a separate wash stage may be utilized where liquified butane or similar volatile hydrocarbon contacts the agglomerates under sufficient pressure to maintain the liquid state and after separation from the agglomerates the butane or other volatile hydrocarbon is allowed to evaporate from the bitumen. The butane can be condensed and recycled to this separate wash stage under pressure.

The washed agglomerates are then passed to a desolventizing stage where residual solvent, including substantially all of the internally occluded solvent, is removed by evaporation or distillation and the solvent-free sand discharged. Normally the solvent vapours will be condensed and recycled to the wash stage. Steam stripping may be used in this desolventizing with the residual water from condensation of the steam serving to form a heavy slurry with the sand, this slurry being amenable to pumping or other forms of fluid transport. This slurry can be disposed of without environmental hazard.

It has been found preferable that the extraction-contacting be carried out in an enclosed vessel having a horizontally-disposed axis in which the charge is caused to rotate and tumble about the axis. This vessel may be tilted towards the direction of solids flow to facilitate movement of the charge. Preferably this vessel is lined with a solvent-resistant hydrophobic polymeric material of the type including polyurethanes, certain elastomers and polytetrafluoroethylenes (e.g. Teflon-trademark). It has been found desirable in terms of enhanced light milling action, to include axially disposed lifter ribs widely spaced on the liner or inner periphery of the vessel. The size of these lifters or ribs is chosen to minimize slippage of the charge; usually ribs projecting about 1% of the vessel diameter will be suitable. Also it is desirable to equip the vessel with rotating vapour seals to minimize solvent losses. Any drive means used to rotate ball mills, rod mills, kilns, etc. may be used to rotate the vessel.

The solid-liquid separation means may be for example, a rotary discharge separator incorporated at the end of the extraction-contacting vessel. One suitable type is that described in U.S. Pat. No. 4,406,788, Sept. 27, 1983, F. W. Meadus et al. Other types are described in Perry's Chemical Engineers' Handbook Sixth Edition, Chapter 8, page 31.

Combinations of e.g. countercurrent rotary discharge separators, in series, may be used to facilitate this separation.

As indicated by the dotted lines in FIG. 3, a distinct separation means is optional: instead a combined separation/washing/draining system can be used as indicated in FIG. 4. Various wash+gravity drainage systems can be used; or a vacuum belt filter fitted with counter-current wash means would give effective continuous separation and washing of the agglomerates.

The separation means for removing solvent from the product solution normally will include distillation and condensation units. One suitable unit is described in Perry's Chemical Engineers' Handbook, Chapter 13, pages 75–81.

The agglomerate desolventizer is designed to evaporate solvent from within as well as from the surface of the agglomerates. One alternative would be by direct steam stripping using a conditioning drum of the type described in U.S. Pat. No. 3,509,641, 5 May 1970 modified for use in solvent recovery. Alternatively an indirectly steam heated rotary tube dryer of the type described in Perry's Chemical Engineers' Handbook, Chapter 20, page 38 would be operative.

Preferably the entire apparatus is designed for continuous operation with recycle of solvent as indicated in FIGS. 3 and 4. Small amounts of make-up solvent are added as necessary. The following Examples are illustrative.

EXAMPLE 1

In a typical continuous experiment using the system outlined in FIG. 3—a medium grade (8.14% bitumen, 1.92% water) oil sands was fed at a rate of 383 g/min into an extraction unit 11.14 inches in diameter rotating at 28 rpm (35% of critical speed). The extracting solvent, a dilute bitumen solution containing 14.04% bitumen in Syncrude diluent naphtha, was fed into the unit, containing 15 one inch diameter steel mixing rods, at a rate of 424 g/min. Water at a pH of 8.5 (with NaOH) was added at the rate of 28.03 g/min. This gave a pulp density in the extraction unit of 41.7%. A residence time of 5.05 min in the extraction-agglomeration unit was sufficient for good agglomeration of the mineral component. After exiting, a product stream containing 19.2% Bitumen was separated from the agglomerated mineral matter in a continuous decantation settler. The agglomerated solids were counter-currently washed with fresh naphtha at the rate of 218 g/min in the washing unit producing an underflow solvent containing 5.04% bitumen. Typically the rate of drainage of the agglomerated solids was 1.99 $L/m^2/s$ for a 15.24 cm bed at 55° C. being well within the desired range of 0.7–4 $L/m^2/s$ for a bed of this thickness. A similar bed of non-agglomerated solids was completely plugged (no drainage) after 24 hours. The washed agglomerates exited at a rate of 406 g/min and contained 8.65% water 0.39% bitumen and 6.45% naphtha. This residual naphtha was removed and recovered by steam stripping in a rotating drum sparged with steam to give a waste sand containing 250 ppm naphtha. The overall recovery of bitumen was 95.1%.

EXAMPLE 2

Oil Sands Feedstock:

Low, medium, and high grade oil sands feedstocks were obtained from the Syncrude mine. Typical analyses were as follows:

TABLE I

| | Syncrude (Alberta) Oil Sands | | |
|---|---|---|---|
| | Low Grade | Medium Grade | High Grade |
| Wt % oil | 6.66 | 8.32 | 10.72 |
| Wt % water | 3.85 | 1.71 | 3.54 |
| Wt % solids | 89.49 | 89.97 | 86.36 |
| Wt % fines (solids basis) | 19.87 | 13.17 | 8.72 |

The oil sand feedstocks were screened to remove any material larger than 0.6 cm and then stored in plastic bags. This reduced moisture losses and aging of the sand.

Solvent Feedstock:

The solvent used was a diluent naphtha obtained from the Syncrude commercial oil sands plant.

A pilot plant with a design capacity of 50 kg/h of oil sands was built which consisted of the following stages:

Feed System:

The oil sand was fed to the extraction tumbler by a feed system which used twin screws to accurately control the feed rate. A metering pump fed the bitumen-loaded extractant solution (which is a better solvent than pure naphtha). Water was added as an agglomerating agent or bridging liquid for the clays and sand.

Extraction Tumbler:

The extraction tumbler was cylindrical (about 28 cm inside diam.) and sized to give a residence time of 5 minutes for a feed rate of 50 kg/h of oil sands at a slurry concentration of 55 wt% solids and 25% filling.

The tumbler had an extraction section about 40 cm long and a discharge section. The extraction section permitted the use of steel rods and had a polyurethane liner which reduced abrasion and prevented the moist solids from sticking to the vessel walls. A steel screen separated the extraction section from the discharge section which housed scoops that lift the slurry. A ribbon-screw withdrew the sand from the tumbler into a discharge chute. The unit was equipped with rotating vapour seals to minimize solvent losses. Fifteen steel rods (1 inch diameter×12 inches long) were used for tests so designated.

column temperature, use of rods in tumbler, pH of water and tumbler rotational speed.

Each test lasted 6 to 8 hours and steady-state conditions were usually achieved 2 hours after start-up. The overall mass balances, show that good material closures were obtained. In a typical test the following mass balances were obtained:

MATERIALS BALANCE FOR PILOT PLANT TEST

| IN | | OUT |
|---|---|---|
| OIL SAND (LOW GRADE): 94,600 g<br>(-OIL SANDS SAMPLES = 1,807 g)<br>WATER: 6,780 g | EXTRACTION/<br>AGGLOMERATION | PRODUCT: 94,750 g<br>EXTRACTED SAND: 94,000 g<br>TANK LEVEL<br>ADJUSTMENT: −3,640 g<br>SAMPLES: 9,000 g |
| FRESH SOLVENT: 52,400 g<br>20 WT % SOLUTION<br>(BITUMEN/NAPHTHA): 44,470 g<br>TOTAL FEED: 196,450 g | | TOTAL PRODUCTS: 194,100 g |
| DIFFERENCE (IN–OUT) = 2,350 g = 1.12% | | |

Solid-Liquid Separation:

The tumbler discharge, containing 40 to 60 wt% solids, was fed by gravity to the spiral classifier where the first solid-liquid separation was performed. The agglomerated clays and sands were separated from the bitumen solution and fed to the wash columns. The bitumen solution overflowed the adjustable weir and went to the product clarification section. This equipment configuration was adopted because it allowed a ready assessment of the effectiveness of the agglomeration process. In a commercial operation a continuous unit for washing and draining the agglomerated solids would be employed.

Agglomerates Washing and Draining:

The discharge from the spiral classifier was a thick slurry containing 70 to 80 wt% solids, 6 to 8 wt% bound water and 14 to 22 wt% bitumen solution. The slurry was fed to the agglomerates washing columns where counter-current washing with progressively cleaner solvent removed most of the bitumen from the agglomerates.

The washed and drained agglomerates were discharged from the columns and fed to the solvent recovery unit or desolventizer while the wash solutions were recycled to the extraction tumbler.

Product Clarification:

The bitumen/naphtha solution overflowing from the classifier had a solids content of 0.0 to 4.0 wt%. These solids are thought to be, in part, unagglomerated, oil-wet clay particles. The solids content and size distribution of the particles in the overflow were determined by: the degree of agglomeration, the slurry feed rate to the classifier, and by the operating characteristics of the spiral classifier.

The classifier overflow stream was treated in the flocculation/clarification circuit. The flocculant (50 wt% formic acid aqueous solution) was added to the flocculation tank which has a residence time of up to 30 minutes. The solution then went to a high-capacity clarifier/thickener.

The overflow stream from the clarifier/thickener was collected as product. The slurry underflow stream was discarded or recycled to the extraction tumbler, depending on the test conditions.

Test Conditions:

The test program included the study of eight variables: oil sands grade, tumbler slurry density, extractant bitumen concentration, tumbler residence time, wash Washing Rates:

The results for washing rates ranged between 1.0 and 2.0 $L/m^2/s$, depending on the test conditions. These values show that use of belt filter units would be feasible.

The results showed that those variables which promoted agglomeration (increased slurry density, tumbler rotational speed and residence time, and use of rods) also promoted faster washing rates. The faster washing rates observed when the temperature was increased were probably due to lower viscosities and better bitumen extraction.

Figure 5:
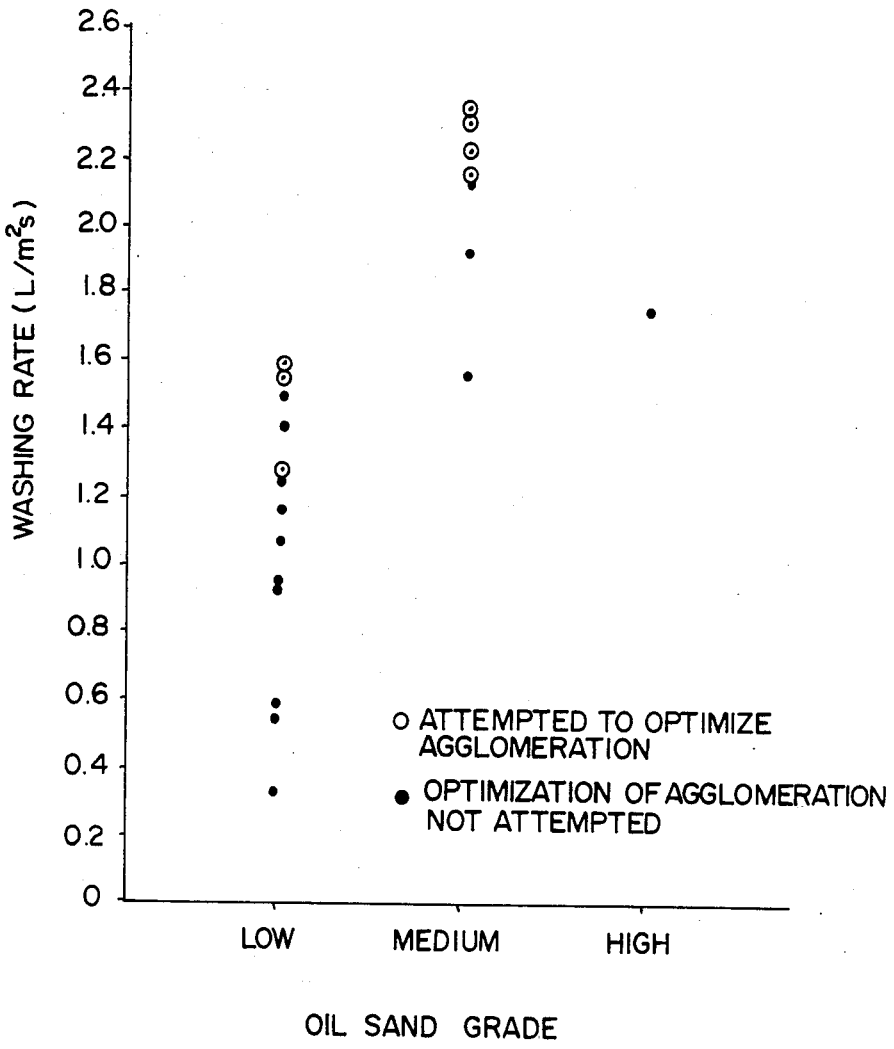
FIG. 5 is a graph showing the variation in agglomerates washing rate with agglomeration optimization for three oil sand grades.

Washing rates were significantly dependent upon the ore grade as shown in FIG. 5. The richer ores had less bed compaction and faster draining rates. It appears that the bed formed by low grade materials was more likely to "blind" because of unagglomerated fines and residual bitumen that would tend to clog pore spaces.

Naphtha and Bitumen Content of Extracted Sand:

Low grade ore tests produced an extracted sand containing more naphtha than that of a medium grade ore processed under identical conditions. It was concluded that the physical characteristics of the fines in this low grade ore caused more naphtha to be trapped inside the agglomerates.

Figure 6:
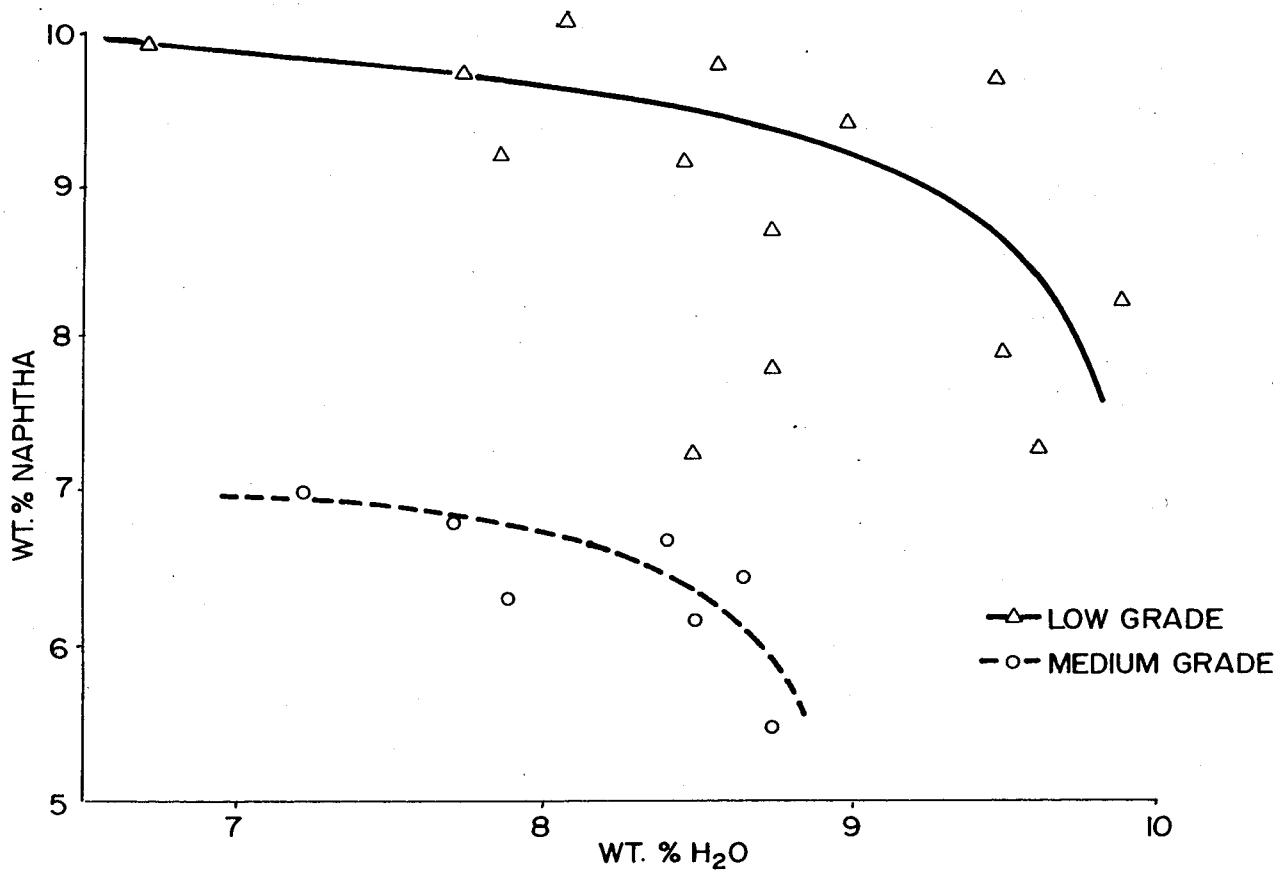
FIG. 6 is a graph showing the decrease in intraagglomerate solvent (naphtha) as bridging liquid (water) is increased over a narrow range, for two grades of oil sands.

FIG. 6 and Table II show the effect of water addition on the naphtha content of the washed sand for the low and medium grades. A decrease in the naphtha content of the sand was observed as the water content was increased indicating that the naphtha content could be controlled and optimized by varying the water addition. However, the experimental program did not allow for further studies of this optimization. Residual bitumen levels of the extracted sand ranged between 0.2 and 0.5 wt%, Table II. It is believed that these naphtha and bitumen levels in the sand could be decreased even further.

Bitumen Recovery:

Table III summarizes the results for bitumen recovery. The factors that increased oil recovery were:

Higher ore grades:

The more extensive agglomeration required by low grade ores caused more bitumen solution to be trapped which was not recovered even after washing and draining.

Lower slurry density:

A lower degree of agglomeration, achieved by low slurry density, decreased the amount of bitumen trapped inside the agglomerates.

Lower extractant loading:

Lower initial bitumen content of the extractant caused faster and more complete dissolution of bitumen.

Higher temperatures:

As expected from previous studies, increased temperature promoted faster and more complete dissolution of bitumen.

Use of rods:

Continual ablation of particles and large agglomerates allowed further extraction and dissolution of bitumen.

Product (Diluted Bitumen) Quality:

The effects of operating parameters on bitumen product quality were inconclusive due to cycling in the tumber and poor control of the clarifier.

The solids levels, ranging between 2 and 12 wt% on a bitumen basis, would indicate that further treatment is needed. However, the operation of the pilot plant was not optimized in these tests, and the product quality could be improved by optimizing the process and/or by choosing different solid-liquid separation equipment, i.e., the engineering aspects.

TABLE II

| Naphtha and Bitumen Content of Extracted Sand | | | | | |
|---|---|---|---|---|---|
| Test | Wt. % Naphtha in Extracted Sand | Wt % Bitumen in Extracted Sand | Wt. % Water* in Extracted Sand | Oil Sand Grade | Rods Used |
| 1 | 9.40 | 0.32 | 9.02 | Low | Yes |
| 2R | 7.84 | 0.39 | 9.75 | Low | Yes |
| 3 | 10.10 | 0.35 | 8.11 | Low | Yes |
| 4 | 9.91 | 0.28 | 6.80 | Low | Yes |
| 4R | 9.67 | 0.32 | 9.54 | Low | Yes |
| 6 | 8.73 | 0.36 | 8.80 | Low | No |
| 6R | 9.22 | 0.46 | 7.87 | Low | No |
| 7 | 7.23 | 0.37 | 8.51 | Low | Yes |
| 8 | 6.43 | 0.39 | 8.65 | Med. | Yes |
| 9 | 8.23 | 0.28 | 9.93 | Low | Yes |
| 10 | 7.80 | 0.33 | 8.80 | Low | Yes |
| 10R | 7.32 | 0.40 | 9.60 | Low | Yes |
| 11 | 7.92 | 0.43 | 9.46 | Low | Yes |

TABLE II-continued

| Naphtha and Bitumen Content of Extracted Sand | | | | | |
|---|---|---|---|---|---|
| Test | Wt. % Naphtha in Extracted Sand | Wt % Bitumen in Extracted Sand | Wt. % Water* in Extracted Sand | Oil Sand Grade | Rods Used |
| 12 | 9.16 | 0.44 | 8.47 | Low | No |
| 13 | 6.29 | 0.32 | 7.87 | Med. | Yes |
| 15 | 6.69 | 0.29 | 8.38 | Med. | Yes |
| 16 | 5.48 | 0.34 | 8.66 | Med. | Yes |
| 17 | 6.97 | 0.33 | 7.16 | Med. | Yes |
| 17R | 6.82 | 0.29 | 7.72 | Med. | Yes |
| 18 | 6.10 | 0.28 | 8.50 | Med. | Yes |
| 20 | 9.80 | 0.37 | 8.57 | Low | No |
| 21 | 6.30 | 0.31 | 8.01 | High | Yes |

*pH of this bridging liquid was 8.5 for all tests except No. 11 where pH was 9.5

TABLE III

| Oil Recovery - Summary Results | | | | | | | |
|---|---|---|---|---|---|---|---|
| Test | % Oil Recovery | Oil Sands Grade wt % Bitumen | Tumbler Residence Time (min) | Extractant Concentrat'n (wt % bitumen) | Tumbler Slurry Density (wt %/Solids) | Wash Column Temperature (°C.) | Make-Up Solution Concentrat'n wt % Bitumen |
| 1 | 94.44 | Low: 6.37 | 5.62 | 7.36 | 38.5 | 20 | 20 |
| 2R | 93.31 | Low: 6.54 | 5.64 | 12.87 | 37.2 | 35 | 20 |
| 3 | 94.68 | Low: 7.08 | 5.46 | 14.06 | 41.0 | 55 | 20 |
| 4 | 95.28 | Low: 6.32 | 5.89 | 5.58 | 32.9 | 55 | 10 |
| 4R | 95.10 | Low: 7.02 | 5.03 | 9.13 | 37.5 | 55 | 10 |
| 6 | 94.03 | Low: 6.44 | 8.38 | 16.30 | 38.4 | 55 | 20 |
| 6R | 92.39 | Low: 6.32 | 7.93 | 12.97 | 37.3 | 55 | 20 |
| 7 | 93.62 | Low: 6.09 | 7.62 | 13.68 | 52.5 | 55 | 20 |
| 8 | 95.10 | Medium: 8.14 | 5.65 | 14.04 | 36.7 | 55 | 20 |
| 9 | 95.94 | Low: 7.15 | 5.65 | 9.53 | 37.4 | 55 | 20 |
| 10 | 95.00 | Low: 6.45 | 7.95 | 9.63 | 49.8 | 55 | 10 |
| 10R | 94.01 | Low: 7.14 | 8.02 | 10.29 | 48.1 | 55 | 10 |
| 11 | 93.15 | Low: 6.63 | 7.10 | 13.79 | 55.8 | 55 | 10 |
| 12 | 92.03 | Low: 6.17 | 16.51 | 12.36 | 55.8 | 55 | 10 |
| 13 | 95.99 | Medium: 8.18 | 7.92 | 6.37 | 51.8 | 55 | 10 |
| 15 | 96.40 | Medium: 8.53 | 5.42 | 6.23 | 48.9 | 55 | 10 |
| 16 | 96.37 | Medium: 8.15 | 7.66 | 7.98 | 52.0 | 35 | 20 |
| 17 | 96.10 | Medium: 8.35 | 7.31 | 14.70 | 54.7 | 35 | 10 |
| 17R | 96.72 | Medium: 8.57 | 7.92 | 9.52 | 49.3 | 35 | 10 |
| 18 | 96.45 | Medium: 8.34 | 5.54 | 8.55 | 47.0 | 55 | 10 |
| 20 | 95.91 | Low: 6.86 | 9.86 | 8.31 | 42.5 | 55 | 10 |
| 21 | 96.86 | High: 10.72 | 6.50 | 17.17 | 39.6 | 55 | 20 |

The effect of various operating parameters on bitumen recovery, on draining rates of agglomerate bed, and on naphtha content of extracted sand (agglomerates) is summarized in Tables IV, V and VI.

Table V summarizes the results for solid-liquid separation. The factors that increased drainage rates were:

Higher ore grades (corresponding to lower fines content):

Coarser particulate solids required less agglomeration to produce the required agglomerate size for satisfactory drainage. Lower ore grades can be made to produce larger agglomerates by increasing the amount of aqueous bridging liquid.

Higher slurry consistency (density):

By increasing the proportion of solids in the slurry the possibility of contacts between particles was also increased. This enhanced the agglomeration of the solids and resulted in a larger agglomerate size, giving faster drain rates during separation of the liquid and solid phases.

Extractant concentration/Tumbler residence time/pH of bridging liquid:

Changes in these variables during agglomeration did not significantly affect drain rates during the solid-liquid separation stages.

Temperature:

Although the results were somewhat inconsistent they do show the general trend of increasing drainage rates at higher temperatures. This corresponds to lower viscosity of the liquid phase.

Use of Rods:

The use of rods (mixing media) in the tumbler had a major positive effect on drainage rates. Rods are believed to have the effect of promoting mixing (which enhanced the agglomeration of fines) and also of comminuting larger agglomerates to produce a more uniform size distribution. The combination of these effects was to increase the porosity of beds formed from the agglomerates, thus allowing freer passage of draining liquid and therefore higher drainage rates.

Higher Tumbler RPM:

Increasing the tumbler rpm resulted in a greater degree of agglomerate attrition/comminution, leading to an overall decrease in agglomerate size, which, in turn, reduced the drainage rate during solid-liquid separation.

Naphtha Content of Drained, Extracted Sand

Table VI summarises the effect of changes in operating variables on the naphtha content of drained, extracted sand. This is an important factor in residual solvent recovery.

Extractant concentration/Tumbler residence time/-Temperature/pH:

Changes in these variables during agglomeration had little or no effect on residual naphtha content of the drained said bed.

Oil sand grade:

Under the same operating conditions low grade oil sands agglomerates tended to retain more residual naphtha than the higher grades. This is owing to a combination of smaller agglomerate size and a greater probability of internal occlusion of solvent, because of fines-solvent interaction, in the former case. This problem can be overcome to a certain extent, by using higher bridging liquid levels for the lower grade materials, see FIG. 6.

Slurry consistency (density):

Larger agglomerates were produced at higher solids loading in the slurry and this resulted in larger inter-agglomerate pore sizes, which, in turn, allowed more complete draining.

Rods:

The effect of rods was to improve agglomeration of the particulate solids which resulted in freer draining beds with lower residual naphtha contents.

Tumbler rpm:

Faster rotation of the tumbler generated fines which plug pores in the agglomerate beds, resulting in higher residual saturation of wash solvent after drainage.

TABLE IV

Effect of Operating Parameters on Bitumen Recovery - Test Comparisons

| Operating Variable | Test | Parameter Level | Bitumen Recovery (%) | Std. Dev. |
|---|---|---|---|---|
| Oil Sand Grade | 3 | Low | 94.68 | |
| | 8 | Med. | 95.10 | |
| | All | Low | 94.21 | 1.17 |
| | All | Med. | 96.16 | 0.49 |
| Slurry Density | 6, 6L | Low | 94.03, 92.39 | |
| | 12 | High | 92.03 | |
| | All | Low | 94.62 | 1.07 |
| | All | High | 95.08 | 1.54 |
| Extractant Concentration | 3 | High | 84.68 | |
| | 4, 4R, 9 | Low | 95.28, 95.10, 95.94 | |
| | 7 | High | 93.62 | |

TABLE IV-continued

Effect of Operating Parameters on Bitumen Recovery - Test Comparisons

| Operating Variable | Test | Parameter Level | Bitumen Recovery (%) | Std. Dev. |
|---|---|---|---|---|
| | 10, 10R | Low | 95.00, 94.01 | |
| | 17 | High | 96.10 | |
| | 16, 17R | Low | 96.37, 96.72 | |
| | 6, 6R | High | 94.03, 92.39 | |
| | 20 | Low | 95.91 | |
| | All | High | 93.82 | 1.23 |
| | All | Low | 95.63 | 0.82 |
| Tumbler Residence Time | 13 | High | 95.99 | |
| | 18 | Low | 96.45 | |
| | All | High | 94.61 | 1.55 |
| | All | Low | 95.19 | 0.94 |
| Temperature | 1 | Low | 94.44 | |
| | 4, 4R, 9 | High | 95.28, 95.10, 95.94 | |
| | 2R | Med. | 93.31 | |
| | 3 | High | 94.68 | |
| | All | Low | 94.44 | 0.00 |
| | All | Med. | 95.63 | 1.33 |
| | All | High | 94.69 | 1.33 |
| Rods | 7 | With | 93.62 | |
| | 12 | Without | 92.03 | |
| | All | With | 95.16 | 1.12 |
| | All | Without | 93.59 | 1.54 |
| pH | All | Low | 93.15 | 0.00 |
| | All | High | 94.94 | 1.33 |
| Tumbler rpm | 15 | High | 96.40 | |
| | 18 | Low | 96.45 | |
| | All | High | 94.71 | 1.35 |
| | All | Low | 96.22 | 0.00 |

TABLE V

Effect of Operating Variables on Draining Rates - Test Comparisons

| Operating Variable | Test | Parameter Level | Draining Rate ($L/m^2s$) | Std. Dev. |
|---|---|---|---|---|
| Oil Sand Grade | 3 | Low | 1.16 | |
| | 8 | Med. | 1.91 | |
| | All | Low | 1.10 | 0.38 |
| | All | Med. | 2.09 | 0.26 |
| Slurry Density | 6, 6L | Low | 1.40, 0.94 | |
| | 12 | High | 0.55 | |
| | All | Low | 1.11 | 0.43 |
| | All | High | 1.72 | 0.54 |
| Extractant Concentration | 3 | High | 1.16 | |
| | 4, 4R, 9 | Low | 0.95, 1.24, 1.49 | |
| | 7 | High | 1.28 | |
| | 10, 10R | Low | 1.59, 1.55 | |
| | 17 | High | 2.15 | |
| | 16, 17R | Low | 2.14, 2.30 | |
| | 6, 6R | High | 1.40, 0.94 | |
| | 20 | Low | 0.32 | |
| | All | High | 1.30 | 0.46 |
| | All | Low | 1.52 | 0.64 |
| Tumbler Residence Time | 13 | High | 2.35 | |
| | 18 | Low | 1.55 | |
| | All | High | 1.49 | 0.64 |
| | All | Low | 1.35 | 0.47 |
| Temperature | 1 | Low | 0.59 | |
| | 4, 4R, 9 | High | 0.95, 1.24, 1.49 | |
| | 2R | Med. | 1.07 | |
| | 3 | High | 1.16 | |
| | All | Low | 0.59 | 0.00 |
| | All | Med. | 1.92 | 0.49 |
| | All | High | 1.36 | 0.52 |
| Rods | 7 | With | 1.28 | |
| | 12 | Without | 0.55 | |
| | All | With | 1.58 | 0.51 |
| | All | Without | 0.80 | 0.41 |
| pH | All | Low | 1.44 | 0.59 |
| | All | High | 1.28 | 0.00 |
| Tumbler rpm | 15 | High | 2.22 | |
| | 18 | Low | 1.55 | |
| | All | High | 1.38 | 0.57 |

TABLE V-continued

| Effect of Operating Variables on Draining Rates - Test Comparisons | | | | |
|---|---|---|---|---|
| Operating Variable | Test | Parameter Level | Draining Rate ($L/m^2s$) | Std. Dev. |
| | All | Low | 1.95 | 0.40 |

TABLE VI

| Effect of Operating Variables on Naphtha Content of Extracted Sand | | | | |
|---|---|---|---|---|
| Operating Variable | Test | Parameter Level | Wt. % Naphtha in Extracted Sand | Std. Dev. |
| Oil Sand Grade | 3 | Low | 10.10 | |
| | 8 | Med. | 6.43 | |
| | All | Low | 8.74 | 0.96 |
| | All | Med. | 6.40 | 0.47 |
| Slurry Density | 6, 6L | Low | 8.73, 9.22 | |
| | 12 | High | 9.16 | |
| | All | Low | 8.93 | 1.09 |
| | All | High | 7.07 | 0.95 |
| Extractant Concentration | 3 | High | 10.10 | |
| | 4, 4R, 9 | Low | 9.91, 9.67, 8.23 | |
| | 7 | High | 7.23 | |
| | 10, 10R | Low | 7.80, 7.32 | |
| | 17 | High | 6.97 | |
| | 16, 17R | Low | 5.48, 6.82 | |
| | 6, 6R | High | 8.73, 9.22 | |
| | 20 | Low | 9.80 | |
| | All | High | 8.18 | 1.14 |
| | All | Low | 7.80 | 1.52 |
| Tumbler Residence Time | 13 | High | 6.29 | |
| | 18 | Low | 6.10 | |
| | All | High | 7.73 | 1.24 |
| | All | Low | 8.26 | 1.49 |
| Temperature | 1 | Low | 9.40 | |
| | 4, 4R, 9 | High | 9.91, 9.67, 8.23 | |
| | 2R | Med. | 7.84 | |
| | 3 | High | 10.10 | |
| | All | Low | 9.40 | 0.00 |
| | All | Med. | 7.05 | 0.94 |
| | All | High | 8.16 | 1.34 |
| Rods | 7 | With | 7.23 | |
| | 12 | Without | 9.16 | |
| | All | With | 7.66 | 1.36 |
| | All | Without | 9.23 | 0.38 |
| pH | All | Low | 7.92 | 0.00 |
| | All | High | 7.96 | 1.42 |
| Tumbler rpm | 15 | High | 6.69 | |
| | 18 | Low | 6.10 | |
| | All | High | 8.14 | 1.32 |
| | All | Low | 6.20 | 0.10 |

Extractant concentration in Tables IV, V and VI means the concentration of bitumen in the recycled naphtha fed to the extraction-contacting stage.

For some of the operating variables, the results obtained were insufficient to constitute an optimization. The parameter level within the operative ranges (i.e. whether in the low, medium or high portion of the range) does indicate the trend caused by changes in the parameter level. The results indicate that further improvement in bitumen recovery and in low solids remaining in the bitumen can be achieved (while retaining high draining rates and low retention times) by concurrent optimization of the variables.

EXAMPLE 3

In other tests using the counter-current agglomerator-extractor, shown in FIG. 2, process optimization has given much better results. For example during an intermittent extended run (34 hours) with a poor quality feed containing 5–9% bitumen and 35–55% fines, after stabilization of process conditions long periods (e.g. up to 6 hours) were found where the solids content of the clarified bitumen solution did not exceed 2.5 w/w% solids (bitumen basis). This is an excellent result for this type of feed material. For higher grade feed with coarser grain particles, even better results are to be expected (e.g. as low a 0.13% solids with a feed containing 9% fines as found in earlier tests using a paddle mixer type/screen system for agglomeration/solid-liquid separation).

The desolventizing of the agglomerates may also be carried out in a unit which includes a fluid bed dryer using steam, inert gas, or superheated solvent vapours as the fluidizing medium.

The following examples 4 to 7 illustrate the following features operating in the system of FIG. 4:

(a) Use of rods (varying number) in extraction/agglomeration.

(b) Removal of fines by filtration through an agglomerate bed.

(c) Optimization of water content during extraction agglomeration with regard to bitumen recovery and drainage rates through bed.

(d) Operation at elevated bitumen concentrations.

Bed permeability was determined according to "Physics of Flow Through Porous Media" by Adrian E. Scheidegger, University of Toronto Press, 1957, page 54.

EXAMPLE 4

The effect of rod mixing media on agglomerate bed properties was investigated (tests 1609-1 to 4). (Extractor output was loaded directly into wash column.) Extraction/agglomeration conditions:

(1) Extraction with Stoddard solvent (Imperial Oil Varsol—trademark).

(2) Drum speed=16 rpm (20.1% of critical speed).

(3) Solvent amount controlled to give product solution concentration=30% bitumen.

(4) Recycle solution rate adjusted to give 50% pulp density in extractor output.

(5) Water addition adjusted to give water:solids ratio of 1:10 in extraction/agglomeration.

(6) Residence time=6±1.6 min in extraction/agglomeration.

(7) Pulp density in extractor=67±5% solids.

(8) Feed Rate 10 kg/hr of oil sands containing 23.0% fines (<44 μm).

Figure 7:
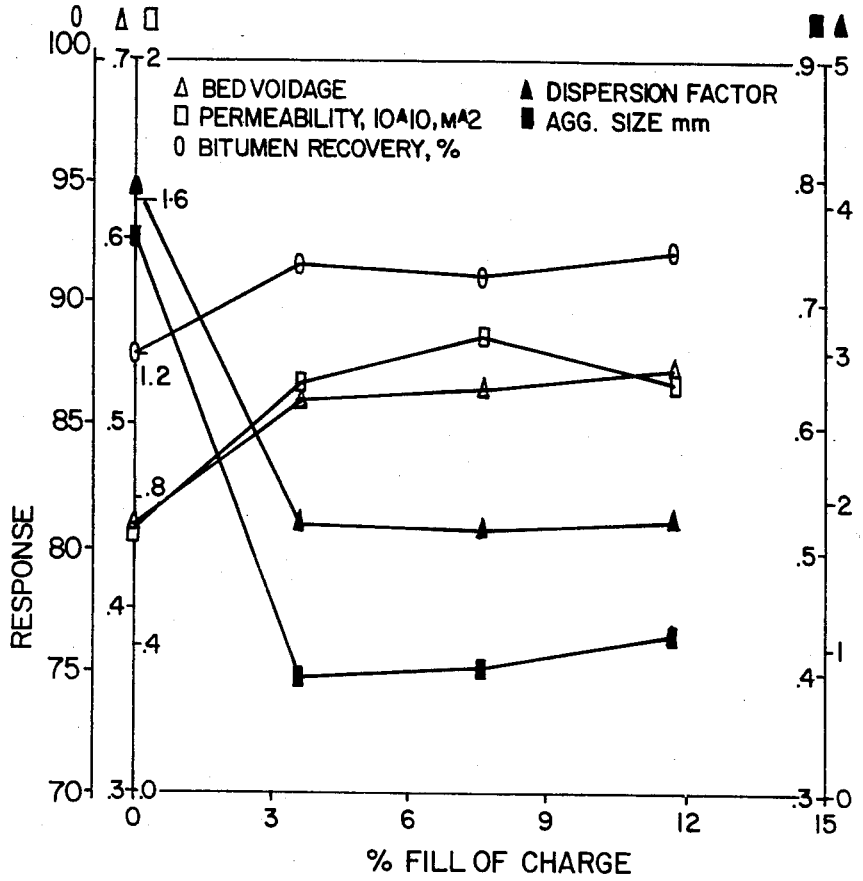
FIG. 7 is a graph showing the change in agglomerate bed voidage (agglomerate separation/washing stage), bed permeability ($10^{10}$, $M^2$), bitumen recovery, dispersion factor and agglomerate size, in the absence (control) and presence of three level of tumbling or mixing media (rods) durwing the extraction/agglomeration.

The resulting agglomerate bed properties are summarized in Table VII and FIG. 7.

TABLE VII

| Mixing Media (% Vol. fill) of charge | Bitumen Recovery (w/w %) | Bed Porosity Fraction | Permeability ($\times 10^{10}$ $M^2$) | Size Dispn factor | Mean Agg. Diam (mm) |
|---|---|---|---|---|---|
| 0 (0)+ | 88.0 | 0.446 | 0.71 | 4.110 | 0.752 |
| 3.6 (8) | 91.9 | 0.513 | 1.11 | 1.827 | 0.395 |
| 7.6 (17) | 91.0 | 0.519 | 1.24 | 1.791 | 0.402 |
| 11.6 (26) | 91.5 | 0.529 | 1.11 | 1.851 | 0.428 |

| Normalized Drain Rates ($L/m^2$ sec) @ 20° C.* | | |
|---|---|---|
| Product Solution | Wash 1 (5% bitumen) | Wash 2 (clean solvent) |
| 0.26 (0.44)++ | 0.47 (0.54) | 0.66 (1.12) |
| 0.29 (0.49) | 0.54 (0.91) | 0.91 (1.54) |
| 0.36 (0.61) | 0.51 (0.86) | 0.77 (1.30) |
| 0.41 (0.70) | 0.68 (1.16) | 1.05 (1.79) |

+Nos. in parenthesis indicate number of rods

++Number in parenthesis are predicted, normalized drain rates at 50° C.

*For 20 cm bed depth and 30% bitumen solution

Flow Rate

Normalization procedure: Darcy's Equation was used to determine flow at given bed height and liquid viscosity (corresponding to 30% (w/w) bitumen solution), assuming that the pressure drop is the same in all cases.

oil sands is usually associated with high bitumen saturation and consequently greater contamination of the fines with adsorbed organics. These contaminated fines tend to be dispersed in the solution phase rather than being agglomerated with the bulk of the solids, which is the case for water wettable fines.

TABLE VIII

| | High Fines Feed | | | | | Low Fines Feed | |
|---|---|---|---|---|---|---|---|
| Test No. | 1609-2R | 1609-3 | 1609-4 | 1611-1 | 1611-2 | 1612-1 | 1612-2 |
| Input Stream | | | | | | | |
| % Fines* | 1.0 | 2.0 | 4.2 | 0.7 | 0.6 | 1.3 | 1.5 |
| % Bitumen+ | 38.7 | 33.8 | 33.3 | 44.6 | 48.9 | 44.8 | 45.2 |
| Underflow Stream | | | | | | | |
| % Fines* | 1.1 | 1.4 | 0.8 | 0.5 | 0.5 | 1.0 | 0.9 |
| % Bitumen+ | 38.4 | 33.7 | 36.7 | 48.3 | 48.9 | 46.7 | 48.2 |
| % Fines in Feed | 22.6 | 23.7 | 23.2 | 20.6 | 22.3 | 3.2 | 2.8 |
| Normalized Rich Solution Drain Rate at 50° C. ($L/M^2s$) | 0.49 | 0.62 | 0.33 | 0.68 | 1.55 | 0.41 | 0.31 |
| w/s | 0.096 | 0.097 | 0.095 | 0.112 | 0.123 | 0.099 | 0.072 |
| Residence Time (min) | 5.8 | 8.2 | — | 5.9 | 8.7 | 6.9 | 6.4 |
| Pulp Density in Extractor (w/w %) | 71.8 | 69.4 | — | 59.1 | 67.5 | 71.3 | 70.5 |
| Drum Speed (rpm) | 16 | 16 | 16 | 16 | 16 | 16 | 16 |
| Solvent | Varsol for all tests | | | | | | |
| Bitumen Recovery (w/w %) | 91.3 | 91.5 | 87.1 | 89.9 | 88.2 | 98.3 | 98.6 |

*Based on bitumen content only (wt. solids × 100/wt. bitumen)
+Solids Free Basis Addition of rods to the extractor unit has been found to have two main effects; (1) the agglomerate size decreases, and (2) the size becomes more uniform. This is apparent by comparison of the mean agglomerate diameter and the size dispersion factor ($\overline{D}_W/\overline{D}_N$), where $\overline{D}_N$=number average diameter $\overline{D}_W$=weight average diameter which is 1 for a system where all the particles are the same size and becomes larger as the degree of polydispersity increases. This results in an increase in bed porosity (0.45→0.52) and causes the bed permeability to increaase from $0.71\times10^{-10}M^2$ to $1.1\text{-}1.2\times10^{-10}M^2$.

The drastic drop in agglomerate size appears to be the result of the elimination of unbroken lumps of oil sands on adding even a few rods to the extractor. This is also reflected in a significant increase in bitumen recovery from 88.0% to 91–92% due to addition of rods.

Consideration of drain rates at 50° C. (expected operating temperature) indicates that increasing the number of rods can bring the gravity drain rate up to an acceptable level of at least 0.7 $L/M^2$ sec for all phases of the washing process even when operating at low water levels.

EXAMPLE 5

To investigate the removal of fines by filtration through an agglomerate bed, the output from the extractor/agglomerator was loaded directly into the solids-liquid separation device (FIG. 4). The input and underflow streams were sampled and analysed for suspended solids fines. As can be seen from the accompanying Table VIII, the fines content of the input stream is quite variable, ranging from 0.6–4.2 w/w% based on the bitumen content, whereas the fines content of the underflow is in most cases lower than the input value and always less than the critical level 2 w/w%. It is interesting to note that the fines content of the product solution, from both high and low fines feeds, is comparable. This results from the fact that low fines content in It should be noted that drainage rates may be adversely affected by the presence of fines both as a result of increasing liquid viscosity and by blockage of pores within the bed. However, inadequate drainage rates can be brought within the desired range by adjusting the water content of the agglomerated sand, see experiments 1611-1 and 1611-2. This has the effect of both reducing the fines content in the liquid phase and of increasing the bed permeability itself.

EXAMPLE 6

For this series of agglomerations to investigate the optimization of water content, all conditions were kept constant (as much as possible) except the water-to-solids ratio, which was progressively increased. The effect on agglomeration of higher water content was to increase drastically the mean agglomerate size while broadening the size distribution (higher size dispersion factor). Loosely packed beds made from these agglomerates would therefore be expected to have larger pores but lower porosity. As can be seen from the accompanying Table IX bed porosity does tend to decrease as the water content of the agglomerate increases but only minimally.

In terms of bed permeability, larger pore size and lower pore volume have an opposing effect, with the latter parameter being detrimental to liquid flow through the bed. However, increased pore size (due to larger agglomerates) appears to be the dominant factor and consequently a dramatic increase in drainage rates is observed for beds made from coarser agglomerates.

Consideration of bitumen recovery data shows a decreasing trend with increasing agglomerate size, probably as a result of greater bitumen entrapment within the larger more compact agglomerates. Thus, in order to maximize bitumen recovery (a primary requirement) the water level should be kept as low as possible commensurate with achieving economically viable bed drainage rates. This can best be achieved by operating at water/solids (w/s) ratios between 0.112 and 0.12 for this type of feed.

TABLE IX

Effect of Added Water on Agglomerate Bed Properties

| Test No. | 1610-3 | 1611-1 | 1611-2 | 1611-3 |
|---|---|---|---|---|
| Conditions | | | | |
| w/s wt. ratio | 0.105 | 0.112 | 0.123 | 0.129 |
| % Fill of rod charge | 7.6 | 7.6 | 7.6 | 7.6 |
| Drum Speed (rpm) | 16 | 16 | 16 | 16 |
| Residence Time (min) | 5.7 | 5.9 | 8.7 | 9.8 |
| Pulp Density in Extractor (w/w %) | 66.8 | 59.1 | 67.5 | 69.4 |
| Feed Type | | High Fines | | |
| Bed Properties | | | | |
| Permeability ($M^2 \times 10^{10}$) | 2.54 | 2.60 | 3.90 | 5.13 |
| Bed Porosity | 0.547 | 0.527 | 0.533 | 0.530 |
| Bitumen Recovery (w/w %) | 89.5 | 89.9 | 88.2 | 87.0 |
| Size Disp. Factor | 2.19 | 2.25 | 3.16 | 3.39 |
| Mean Agglomerate Size (mm) | 0.505 | 0.511 | 0.764 | 0.890 |
| Gravity Drain Rates ($L/M^2$ s)* | | | | |
| Rich Soln. | 0.34(0.62)+ | 0.51(0.93) | 1.07(1.95) | 1.33(2.42) |
| Wash 1 | 0.75(1.37) | 1.24(2.26) | 1.88(3.43) | 2.34(4.26) |
| Wash 2 | 1.44(2.63) | 2.43(4.43) | 3.03(5.52) | 3.53(6.42) |

*Rich Solution Drain Normalized to 45 w/w % bitumen solution 20° C.
+Numbers in parenthesis are estmated rates at 50° C.

EXAMPLE 7

For these tests (Table X) the variable was the bitumen concentration in the bitumen solvent phase, which phase also served as the suspending liquid for the agglomeration process. In order to reduce the costs of solvent recovery from the bitumen phase the most economical system will operate with as high a bitumen solution concentration as possible. Provided that the bitumen concentration does not affect significantly the agglomeration process then the governing factor in bed drainage rates will be the liquid viscosity at the process operating temperature.

Examination of those bed properties believed to be most closely associated with liquid flow does not reveal any adverse trends associated with the systematic increase in bitumen concentration. However, at room temperature the viscosity of a 62.3 w/w% bitumen solution was so high that it would barely flow through the bed at all. In fact, the measured liquid flow rates followed the trend in liquid viscosity ($\mu$) but did not vary in the exact ratio of $1/\mu$ as might be expected if this were the only factor involved.

Bitumen recovery also decreased as the bitumen concentration of the solution increased. This is the result of the greater quantity of bitumen present in a given amount of suspending liquid occluded in the agglomerated material. This increased loss of bitumen must be factored into any estimates of the economic advantage of operating at high miscella concentrations.

TABLE X

Effect of Bitumen Concentration on Agglomerate Bed Properties

| Test No. | 1610-1 | 1609-1 | 1610-3 | 1610-2 |
|---|---|---|---|---|
| Bitumen Concentration w/s | 20.5 (0.0025)* | 29.5 (0.0036) | 45.2 (0.0077) | 62.3 (ND) |
| w/s | 0.098 | 0.095 | 0.106 | 0.103 |
| % Fill of rod charge | 7.6 | 7.6 | 7.6 | 7.6 |
| Drum Speed (rpm) | 16 | 16 | 16 | 16 |
| Residence Time (min) | 10.1 | 4.8 | 5.7 | 5.9 |
| Pulp Density in Extractor (w/w %) | 72.6 | 62.3 | 66.8 | 73.2 |
| Feed Type | | High Fines | | |
| Bed Properties | | | | |
| Permeability ($m^2 \times 10^{10}$) | 1.63 | 1.24 | 2.54 | N.M. |
| Bitumen Recovery (w/w %) | 91.8 | 91.0 | 89.5 | 84.9 |
| Bed Porosity | 0.474 | 0.519 | 0.547 | 0.531 |
| Size Disp. Factor | 2.43 | 1.79 | 2.19 | 1.68 |
| Mean Agglomerate Size (mm) | 0.597 | 0.402 | 0.505 | 0.406 |
| Gravity Drain Rates ($L/m^2$ s) @ 20° C. | | | | |
| Rich Soln. | 0.61 | 0.38 | 0.34 | 0.05 |
| Wash 1 | 0.77 | 0.54 | 0.75 | 0.17 |
| Wash 2 | 0.94 | 0.81 | 1.44 | 0.69 |

*Solution viscosity at 20° C., ND = Not Determined, NM = Not Measurable

What is claimed is:

1. A process for continuous concurrent solvent extraction and agglomeration of materials containing intimate mixtures of oil or tar and particulate hydrophilic mineral solids, comprising (a) mixing said materials with a solvent for the oil or tar and with an aqueous bridging liquid, said solvent and liquid being immiscible, to provide a water to solids weight ratio within the range of 0.08 to 0.5, in a vessel slowly rotating about a substantially horizontal axis at a speed selected within the range of 10% to 40% of the critical speed, under selected conditions which favor the agglomeration of solids including any fines and formation of large agglomerates of the solids; and continuously breaking down the agglomerates by a controlled light milling action provided by gently tumbling mixing media present in from 3.6 to 20% of the vessel volume, the weight of each element of the mixing media being large enough to overcome the cohesive forces binding the hydrophilic particles together and to the media elements and where the impact forces involved are not large enough to comminute the solids significantly, thereby causing the bridging liquid to displace internally occluded solvent, oil and tar from the agglomerates and form small agglomerates of reduced size distribution which are substantially free of solvent, oil and tar, and of rapid draining character;

(b) discharging the agglomerated mixture to a solid/liquid separating stage, and separating the agglomerates from the solvent phase;

(c) washing the separated solid agglomerates using a solvent for the oil or tar and separating the wash solvent from said agglomerates;

(d) recycling at least part of the wash solvent recovered from the washing step (c) to the extraction step (a); s (e) stripping solvent from the solution of oil or tar from step (b) and separately recovering solvent and bitumen or other oil or tar product;

(f) desolventizing the washed agglomerates to recover residual solvent;

(g) recycling recovered solvent from (e) and (f) to the washing step (c); and (h) disposing of the waste solids from the desolventized agglomerates as either a dry solid, or heavy slurry in water.

2. The process of claim 1 wherein the vessel is rotating at a speed conducive to both agglomeration and extraction without significant particle comminution, selected within the range of 10% to 20% of the critical speed as defined herein, and said vessel has axially disposed lifter ribs.

3. The process of claim 1 wherein the vessel is tilted towards the direction of solids flow to facilitate movement of the charge.

4. The process of claim 1 with step (a) operated as either co-current or counter-current extraction and agglomeration.

5. The process of claim 1 where the charge occupies between 10 and 60% of the vessel volume and comprises oil sands, solvent and water.

6. The process of claim 5 wherein the feed components are fed to said vessel at rates to give a retention time related to solids particle size and temperature; with feeds containing high fines, or at lower temperatures requiring longer retention times for efficient extraction and agglomeration, but not to exceed about 20 min.

7. The process of claim 5 wherein the charge in the vessel is a slurry having a pulp density in the range of 40% to 73% weight solids.

8. The Process of claim 1 wherein the solvent supplied to the extraction-contacting stage comprises a water-immiscible organic liquid selected from: naphtha fractions from bitumen upgrading; naphtha fractions partially loaded with bitumen; aromatic solvents of the class including benzene, toluene, and xylene; halogenated solvents of the class including methylene chloride, carbon-tetrachloride, trichlorotrifluoroethane and trichloroethylene; and cyclic aliphatic compounds of the class including cyclohexane.

9. The process of claim 1 wherein the solvent to oil or tar ratio in step (a) is selected to give a product solution in step (b) containing from 10% to 70% oil or tar.

10. The process of claim 1 wherein the agglomerate bridging liquid is aqueous and contains additives, selected to promote water wettability of the particulate solid surfaces in order to improve solid-liquid separation efficiency.

11. The process of claim 10 wherein the additives are selected from alkali metal pyrophosphates, orthophosphates, oxalates, alkali metal hyroxides, alkali metal silicates and petroleum sulphonate.

12. The process of claim 1 wherein the temperature during (a) is selected within the range of from above 0° up to 70° C. depending on the solvent used.

13. The process of claim 12 wherein heat is provided via the bridging liquid added in the form of hot water or steam, or via fresh or wash solvent added at an elevated temperature, or via heated, recycled product solution from (b).

14. The process of claim 1 wherein the feed materials containing oil or tar is bituminous tar sand, oil-bearing diatomite, oil shale or tar-saturated sandstones.

15. The process of claim 1 wherein the extraction-contacting in step (a) is controlled to produce agglomerates of the size from about 0.1 mm to about 2 mm diameter containing minimal levels of solvent and oil or tar.

16. The process of claim 1 wherein the extraction-contacting in step (a) is controlled so that the solution separated in step (b) contains less than about 2% average, based on oil or tar in solution, of fine solids.

17. The process of claim 1 wherein the solution in step (b) and the wash solvent in step (c) are separated from the agglomerates by draining at an optimized rate between 0.7–4 $L/m^2/s$, said rate being obtained by controlling the agglomeration parameters in step (a).

18. The process of claim 1 wherein the washing in step (c) includes a stage where the washing solvent comprises a low boiling liquid, maintained above atmospheric pressure, and of the class of butane or fluorinated hydrocarbons, this washing solvent being recovered and recycled to the same washing stage.

19. The process of claim 1 wherein the solvent is stripped from the solution in step (e) by evaporation or distillation and condensation.

20. The process of claim 1, wherein residual solvent is recovered from the washed agglomerates in step (f) by evaporation or distillation and condensation.

21. The process of claim 20 wherein the residual agglomerates are hot and are recycled to step (f) to recover heat.

22. The process of claim 1 wherein the wt. ratio of bridging liquid/solids is selected within the range of 0.08 to 0.15 in step (a) so as to minimise the solvent content of the agglomerates.

23. The process of claim 1 wherein the mixing media are rods of size and weight selected to accomplish breakdown of large agglomerates and reduction in size distribution without comminution of solids.

24. The process of claim 1 wherein the vessel in step (a) has a liner of hydrophobic, solvent-resistant polymeric material.

* * * * *